US008646575B1

(12) United States Patent
Guthrie et al.

(10) Patent No.: US 8,646,575 B1
(45) Date of Patent: Feb. 11, 2014

(54) BEAM ANCHOR

(75) Inventors: Karl Guthrie, Austin, TX (US); Ivan A. J. Kekahuna, Austin, TX (US); Eric Shawn Patrick, Austin, TX (US)

(73) Assignee: Climb Tech, LLC, Austin, TX (US)

( * ) Notice: Subject to any disclaimer, the term of this patent is extended or adjusted under 35 U.S.C. 154(b) by 0 days.

(21) Appl. No.: 13/397,094

(22) Filed: Feb. 15, 2012

(51) Int. Cl.
*A62B 35/00* (2006.01)

(52) U.S. Cl.
USPC ..... 182/3; 182/36

(58) Field of Classification Search
USPC ..... 182/3, 36; 248/200.1, 201, 228.1, 248/228.4, 228.5, 262, 264
See application file for complete search history.

(56) References Cited

U.S. PATENT DOCUMENTS

| | | | | |
|---|---|---|---|---|
| 4,607,724 | A * | 8/1986 | Hillberg | 182/3 |
| 5,758,743 | A * | 6/1998 | Coyle et al. | 182/45 |
| 7,111,707 | B2 * | 9/2006 | Reeves | 182/36 |
| 2007/0163834 | A1 * | 7/2007 | Casebolt | 182/3 |
| 2010/0326767 | A1 | 12/2010 | Guthrie et al. | |

OTHER PUBLICATIONS

Fall Protection Pros, DBI-SALA Glyder 2 Sliding Beam Anchor, from web page at "http/w.w.w.fallprotectionpros.com", publication date unknown.
U.S. Patent Application entitled Beam Anchor, U.S. Appl. No. 12/586,582, filed Sep. 23, 2009.
Economy Advantage, web page at "http://www.fallprotection.com/images/lanyards1new.jpg", publication date unknown.
Inner Mountain Outfitters, web page at "http://innermountainoutfitters.net/catalogentry.php?search=&page=all&catalogentryid=630", publication date unknown.
"Understanding the ANSI Z359 Fall Protection Code", Miller by Sperian, pp. 1-16, publication date unknown.
Pensafe.Ca, web page at "www.pensafe.ca/pdf/miscellaneous.pdf", publication date unknown.
Mountain Gear, webpage at "http://www.mountaingear.com/pages/product/product.asp/imanf/DMM/idesc/Dragon+Cam/Store/MG", publication date unknown.
Mountain Gear, web page at "http://www.mountaingear.com/pages/product/product.asp/imanf/Omega+Pacific/idesc/Link+Cam+Set+-2/Store/MG/item/114316/N/10451", publication date unknown.
Mountain Gear, webpage at "http://www.mountaingear.com/pages/product/product.asp/imanf/Moses+Enterprises/idesc/Tomahawk", publication date unknown.
PK Safety Supply, web page at "http://wwwstore.pksafetynet/dbi-2100085.html", publication date unknown.

* cited by examiner

*Primary Examiner* — James O Hansen
*Assistant Examiner* — Kristine Florio
(74) *Attorney, Agent, or Firm* — Portland Intellectual Property, LLC

(57) ABSTRACT

A beam anchor. The beam anchor includes an elongate cross-member, a lanyard attachment structure attached to the cross-member, a pair of first and second spaced apart beam capturing members attached to the cross-member. Either or both capturing members may have a locking mechanism that is cantilevered from the capturing member, and the lanyard attachment structure may have a lanyard attachment ring connector that is capable of rotating about the cross-member but that is constrained to a fixed position along the cross-member by use of a ring or partial ring structure attached to the cross-member that extends through a slot in the lanyard attachment ring connector.

23 Claims, 4 Drawing Sheets

BEAM ANCHOR

FIELD OF THE INVENTION

The present invention relates to improvements in anchoring devices, typically referred to as beam anchors, for attaching to an I-beam or similar structure, used to provide fall protection.

BACKGROUND

In the construction industry, it is always important, and it is usually a requirement, to protect construction workers against falling from the structures they are constructing. Such "fall protection" is typically provided by equipping workers with harnesses attached by cables called "lanyards" to anchor points on the structure. The lanyard is attached to the harness and anchor point at respective ends by attachment hardware called "caribiners." The caribiners may be provided as permanently installed parts of the lanyard, or the lanyard may be adapted to receive caribiners that are removable from the lanyard. Hereinafter, the term "lanyard" shall be used to refer to a lanyard having caribiners either permanently or removably installed.

The need for fall protection in the case of high-rise structures is obvious, and a characteristic of such structures is the use of I-beams as structural members. Accordingly, a class of anchoring devices known as "beam anchors" has been provided specifically for utilizing I-beams as anchor points.

FIG. 1 shows a typical prior art beam anchor 1. The beam anchor 1 has an elongate cross-bar 2 having an elongate axis "L," and a pair of I-beam capturing members 3, 4 at opposite ends of the cross-bar. The capturing members 3, 4 attach the cross-bar to an I-beam as discussed below in connection with FIG. 2.

A coupler 5 has a circular aperture "A" through which the hook of a lanyard can be attached.

FIG. 2 shows the beam anchor 1 attached to an I-beam. The I-beam has a center section 6 whose primary function is to support two spaced-apart flanges 7, 8 which carry the bulk of the bending load. The beam anchor rides on one of the flanges, here the flange 7, in and out of (i.e., perpendicular to) the plane of the Figure. More particularly, over-hanging capturing portions 3*a*, 4*a* of the capturing members 3, 4 slide on the upper surface 7*a* of the flange 7.

The capturing members 3, 4 are spaced far enough apart to define respective gaps "g" between the capturing members and respective edges 9 (specifically shown as 9*a*, 9*b*) of the flange. These gaps allow the beam anchor to slide as just described without interfering with the edges 9. By riding the flange in this manner, the beam anchor can follow the worker as the worker moves along the I-beam.

FIGS. 3 and 4 show an end portion of a prior art beam anchor 10 that is marketed as the DBI-SALA Glyder 2 Sliding Beam. Anchor, by DB Industries, Inc. of Redwing Minn. The view corresponds to the left end of the beam anchor 1 shown in FIG. 1, both ends being identical. The beam anchor 10 has an elongate cross-bar 12 having an elongate axis "L," and two opposed substantially identical capturing members 14 (only one being shown), the position of each being adjustable along the length of the cross-bar. Each capturing member includes a generally C-shaped capturing portion 14*a*.

To allow the aforementioned position adjustment, a locking mechanism 16 is provided with each capturing member that is adapted to releasably engage grooves 18 defined in the cross-bar. Particularly, the locking mechanism 16 is pivotally attached to the capturing member 14 so that it can pivot about an axis "P." The axis P defines a lever portion 16*a* of the locking mechanism extending above the axis P, and a tongue portion 16*b* of the locking mechanism extending below the axis P.

The tongue portion 16*b* of the locking mechanism 16 is adapted to engage with a selected one of the grooves 18, and the locking mechanism includes a spring 30 (not visible in FIG. 3) for biasing the locking mechanism in any such engaged position, for retaining the capturing member 14 in a locked configuration of the locking mechanism. The locked configuration is shown in FIG. 4.

Returning to FIG. 3, a user manually pressing on the lever portion 16*a* at the location and in the direction indicated by the open arrow against the bias provided by the spring rocks the locking mechanism about the axis P. This raises the tongue portion 16*b* relative to the groove 18 in which it was previously engaged, to disengage the locking mechanism therefrom and define an unlocked configuration of the locking mechanism.

When the locking mechanism is in its unlocked configuration, the capturing member 14 may be manipulated by sliding it axially along the cross-bar 12, to re-position the capturing member for subsequent locking at a new axial position such as that indicated in FIG. 4.

The locking mechanism 16 is pivotally supported between two webs "$W_1$" and "$W_2$," which is the standard practice in the art. This is believed to be for the purpose of guarding the locking mechanism from becoming inadvertently unlocked as a result of coming into contact with the lanyard. However, this guarding makes the locking mechanism 16 less convenient to operate.

The beam anchor 10 has a coupler 15 corresponding to the coupler 5 in the embodiment of FIG. 1. The coupler 5 as shown is able to slide longitudinally on the cross-bar 2. However, the coupler 15 is, as is generally preferred, anchored at a central location on the cross-bar. Typically for this purpose, a pin or screw is installed in the cross-bar, the pin or screw having a projecting head 17. The coupler 15 has a corresponding slot 19 to receive the head 17, which constrains the coupler 15 so that it cannot slide from side to side, while allowing the coupler to rotate axially about the cross-bar, i.e., about its elongate axis "L."

Beam anchors must provide rigorously dependable structural support to function as fall protection, and it is an objective of the present invention to provide for improvements to beam anchors like the beam anchor 10 that allow them to be both stronger and less bulky.

SUMMARY

A beam anchor is disclosed herein. The beam anchor includes a cross-member, a lanyard attachment structure attached to the cross-member, a pair of first and second spaced apart beam capturing members attached to the cross-member, and a locking mechanism.

The cross-member is elongate and defines an elongate axis and two opposed axial directions parallel to the elongate axis. The capturing members are attached to the cross-member so that the spacing between the capturing members is adjustable. The capturing members include respective capturing portions for capturing the flange therebetween so that the beam anchor can hang therefrom.

The locking mechanism is pivotally attached to the associated capturing member via a pivot element supported thereby at a first location on the pivot element. The locking mechanism has a lever adapted for digital manipulation by a user of the beam anchor, allowing the user to pivot the locking mechanism about the pivot element between two configurations of the locking mechanism: (1) a locked configuration wherein the locking mechanism pivotally engages with the cross-member, for locking the capturing member to the cross-member at a selected axial position on the cross-member, and (2) an unlocked configuration wherein the locking member pivotally disengages with the cross-member to release the capturing member from the selected axial position so that it becomes slidable along the cross-member in either of the axial directions.

At least a portion of the lever is captured between the first location and a cantilevered first end of the pivot element.

Preferably, a portion of the lever is captured between the first location and the cantilevered first end of the pivot element, with another portion being captured between the first location and a cantilevered second end of the pivot element, the second end being opposite the first end.

Preferably, the first location is a central location on the pivot element; more preferably, the two portions are symmetrical about the first location; and still more preferably, the lever is also symmetrical about the first location.

Preferably, the at least one capturing member includes a web element connecting to the associated capturing portion, the web element being relatively thin as compared to the associated capturing portion measured in directions perpendicular to the elongate axis, and the pivot element as defined in any of the embodiments noted above extends from the web element.

In another aspect of the invention, the lanyard attachment structure includes a lanyard attachment ring having an aperture therethrough for connecting to a lanyard, and a lanyard attachment ring connector for connecting the lanyard attachment ring to the cross-member.

The lanyard attachment ring connector is disposed around the cross-member between the capturing members. The cross-member defines a cylindrical or semi-cylindrical cross-member surface about the elongate axis making cylindrical or semi-cylindrical contact with an interior surface of the lanyard attachment ring connector. The contact between these two surfaces is sufficiently loose that the lanyard attachment ring connector is capable of rotation relative to the cross-member in circumferential directions about the elongate axis. The lanyard attachment ring connector has a slot extending in the circumferential directions to allow this rotation. The cross-member has a projecting ring or ring portion at a predetermined fixed location thereon that extends through the slot, to capture the lanyard attachment ring connector to the cross-member by preventing sliding of the lanyard attachment ring connector on the cross-member parallel to the elongate axis.

Preferably, the ring or ring portion extends 360 degrees around said cross-member in the circumferential directions.

Preferably, the ring exerts a compressive force on the cross-member, for fixing it at the fixed location.

Preferably, the two aspects of the invention are provided together, so that strength improvements and/or cost and weight savings can be maximized.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DETAILED DESCRIPTION OF PREFERRED EMBODIMENTS

Figure 1:
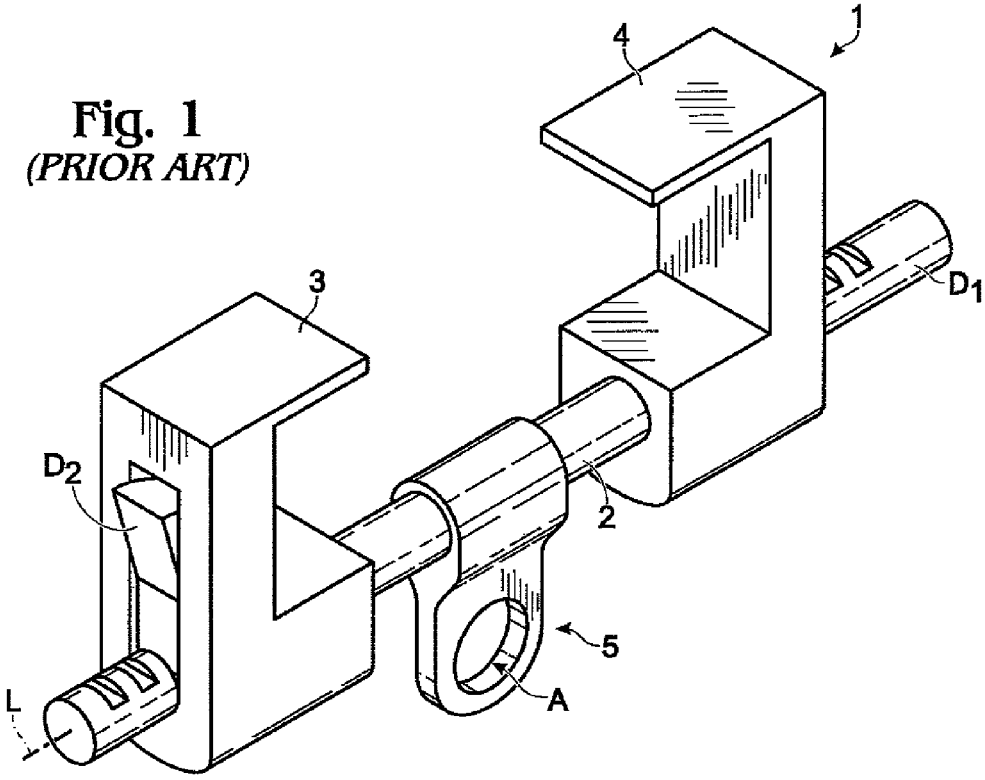
Fig. 1 (PRIOR ART)
FIG. 1 is an isometric view of a basic prior art beam anchor.
Figure 2:
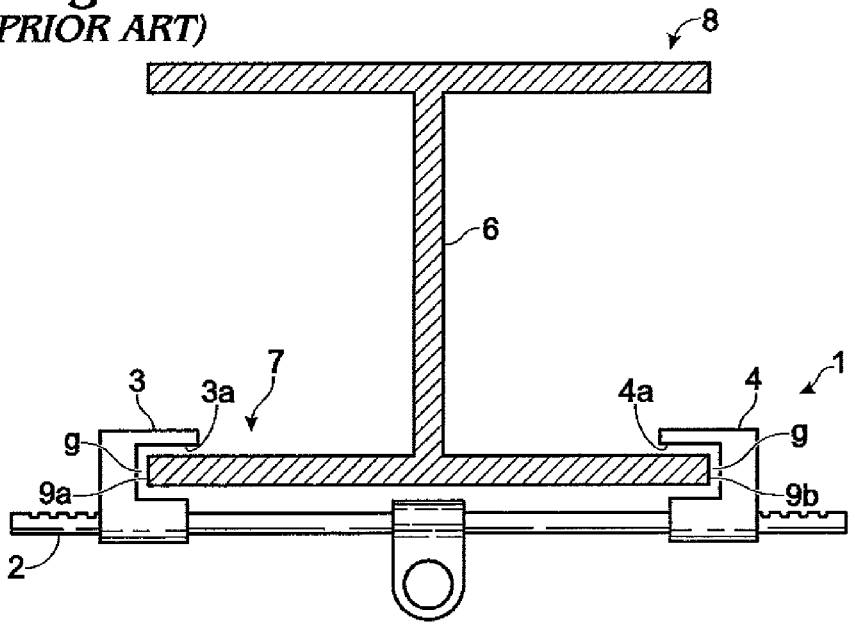
Fig. 2 (PRIOR ART)
FIG. 2 is a side elevation view of the beam anchor of FIG. 1 attached to an I-beam.
Figure 3:
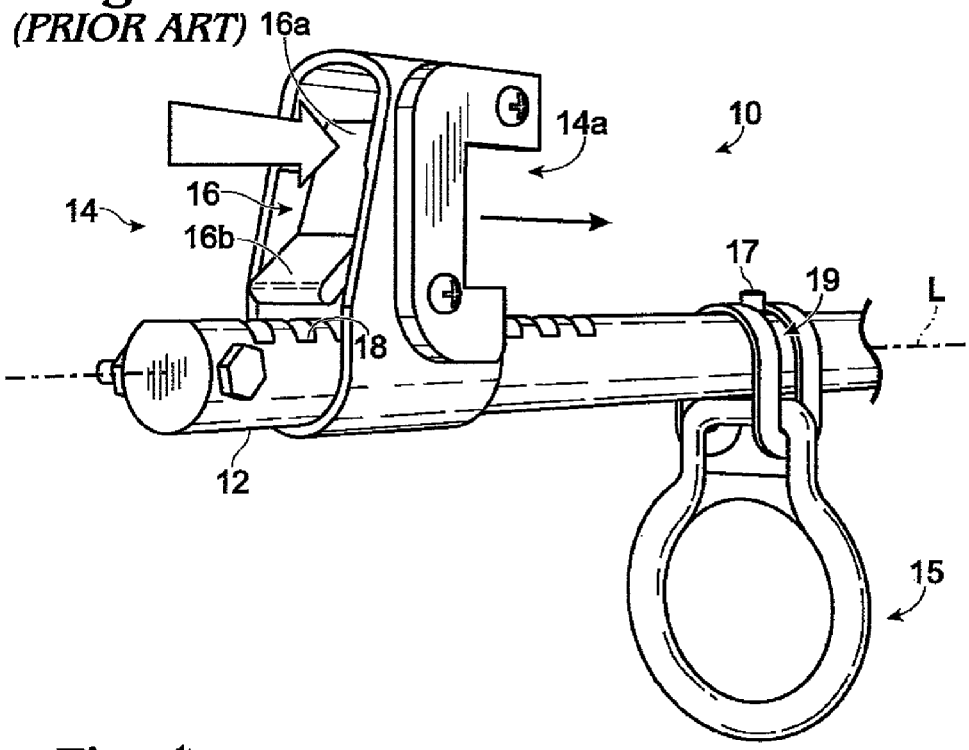
Fig. 3 (PRIOR ART)
FIG. 3 is an isometric partial view of a specific prior art beam anchor, showing a locking mechanism in a locked configuration.
Figure 4:
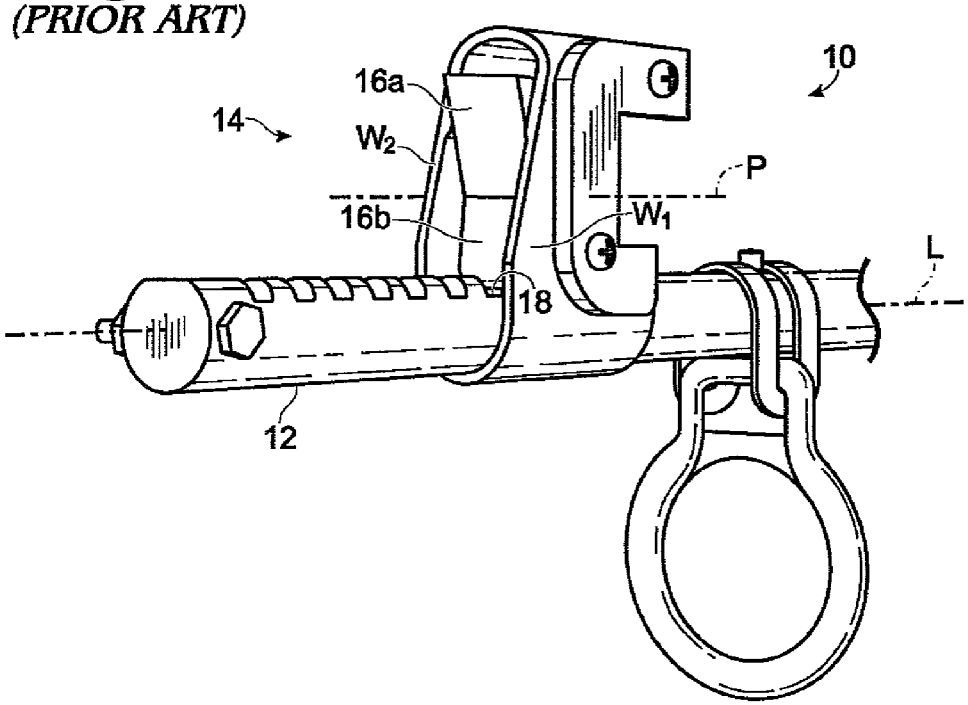
Fig. 4 (PRIOR ART)
FIG. 4 is an isometric partial view of the beam anchor of FIG. 3, showing the locking mechanism in an unlocked configuration.
Figure 5:
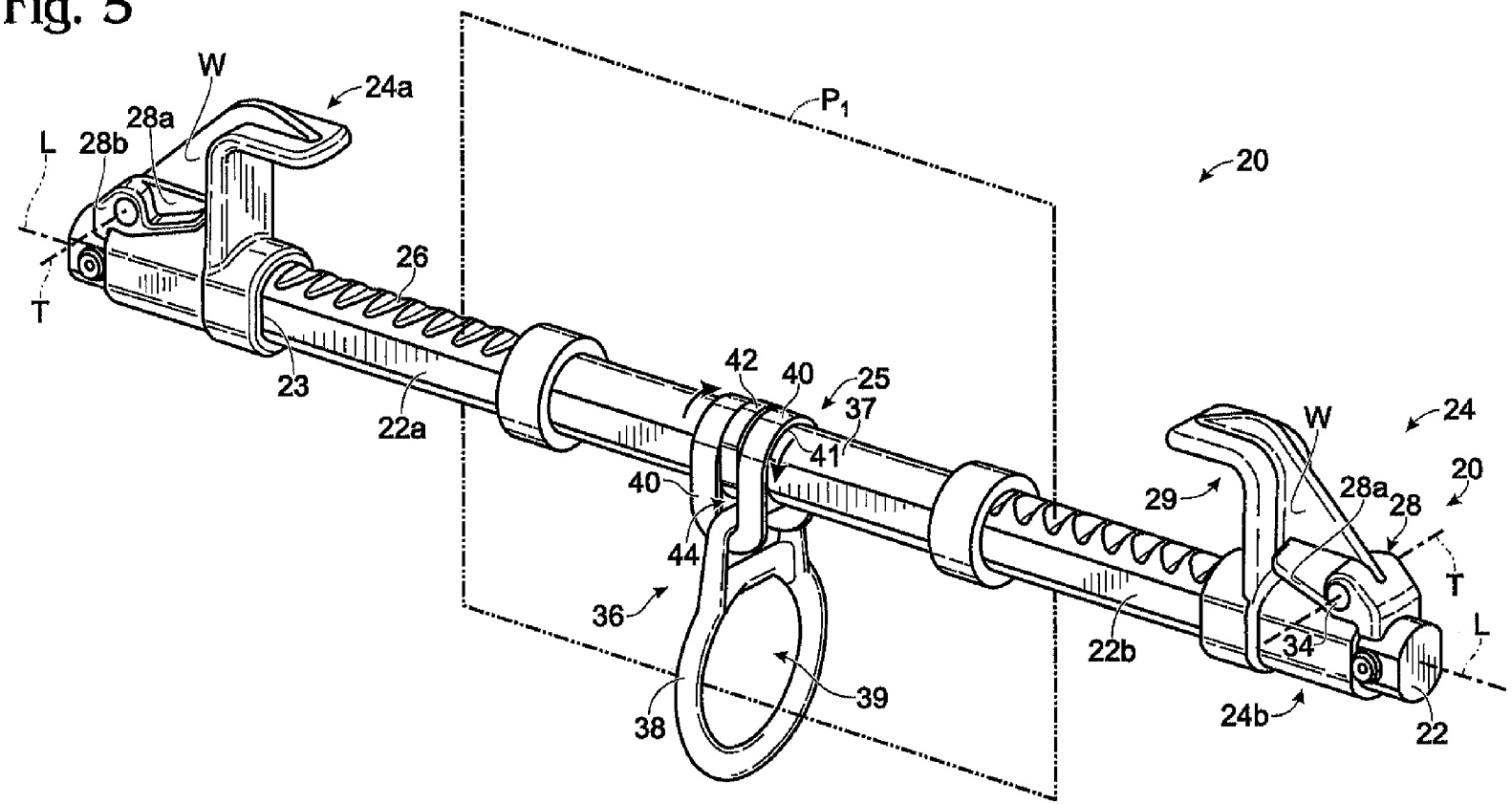
FIG. 5 is an isometric view of a preferred beam anchor according to the present invention.

FIG. 5 shows a first embodiment 20 of a preferred beam anchor according to the present invention. The beam anchor 20 has an elongate, substantially cylindrical cross-bar 22 defining an elongate axis "L." The cross-bar 22 must be strong and robust to serve its purpose as the structural backbone of the beam anchor, and is preferably formed of an aluminum alloy such as the T 70 series; however, the cross-bar could be formed of a different metal or metal alloy such as stainless steel, and it could even be formed of a composite plastic material or a combination of metal and plastic materials. The typical rated load is 5,000 pounds applied in a direction perpendicular to the axis L, at the ring element referenced as 38.

The cross-bar 22 supports two I-beam capturing members 24, namely, 24*a*, 24*b* at opposite ends thereof. Preferably, the two capturing members 24 are substantially identical and are substantially identically connected to the cross-bar 22, but this is not essential. Therefore, the description will refer to either one of the capturing members 24 without loss of generality.

The I-beam capturing member 24 has an aperture 23 for receiving an associated end 22*a* or 22*b* of the cross-bar therethrough. The aperture 23 provides a sufficiently loose fit to the end 22*a* or 22*b* that the capturing member 24 can slide along the end 22*a* or 22*b* parallel to the axis L.

The ends 22*a* and 22*b* of the cross-bar 22 each have an axially spaced series of grooves 26 for engagement with a locking mechanism 28 attached to the capturing member 24, for locking the capturing member 24 in a selected axial position along the associated end 22*a* or 22*b*.

Figure 6:
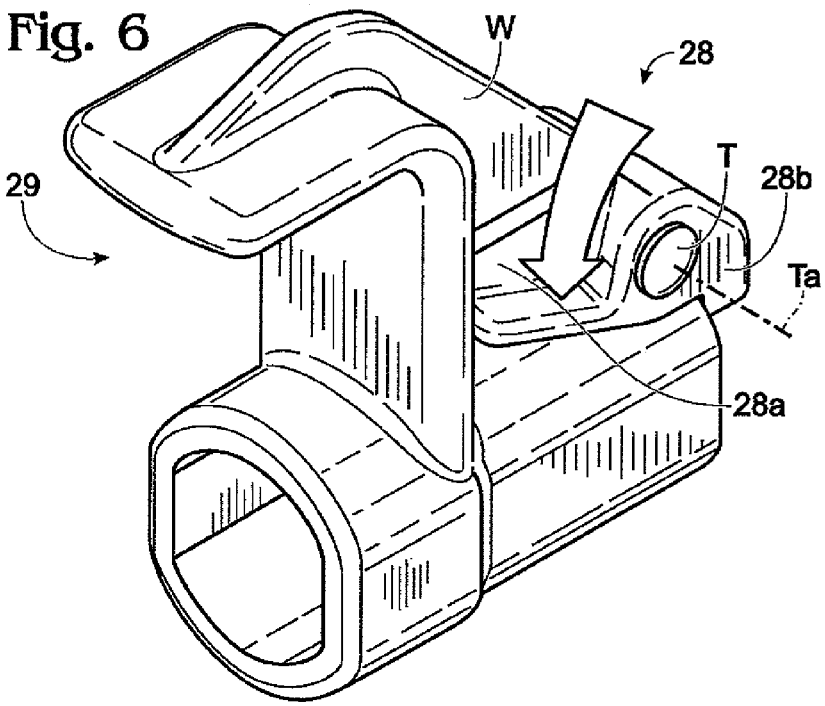
FIG. 6 is an isometric view of a capturing member portion of the beam anchor of FIG. 5.
Figure 7:
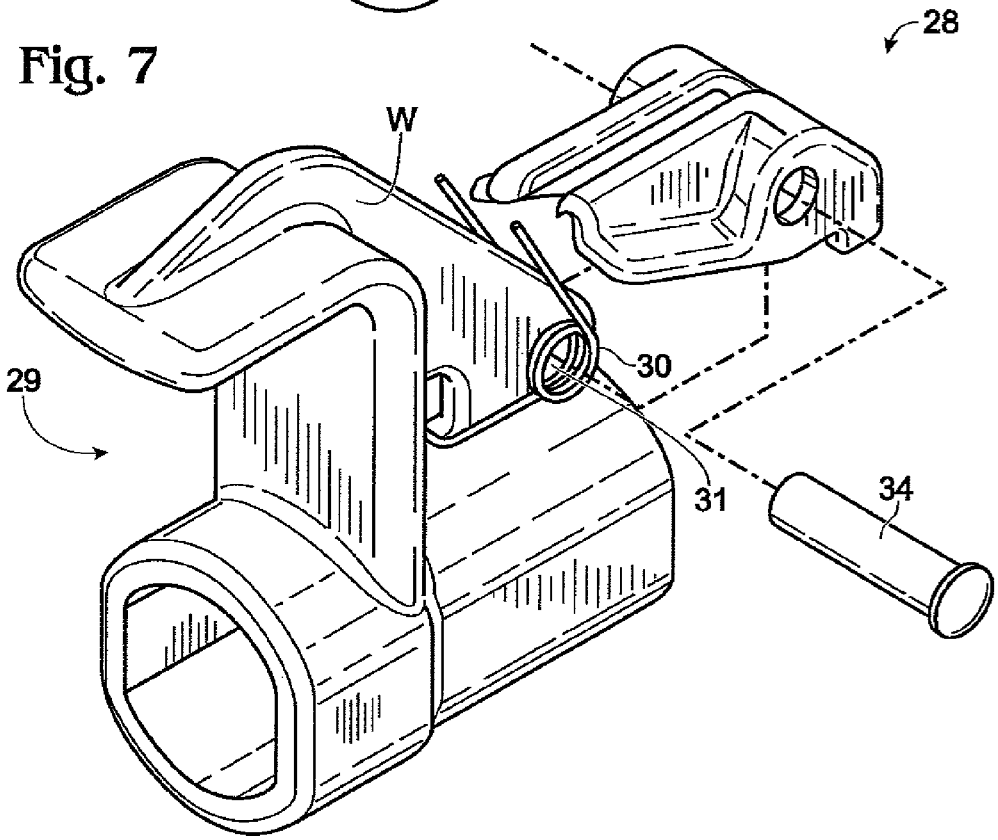
FIG. 7 is an isometric, partially cut-away view of the capturing member of FIG. 6.

FIGS. 6 and 7, showing the capturing members 24 enlarged, show how the locking mechanism 28 is attached to the capturing member. The locking mechanism 28 is pivotally attached to the capturing member 24 so that it pivots about an axis "T." The axis T defines a lever portion 28*a* of the locking mechanism 28, on one side of the axis T, and a tongue portion 28*b* on the other side.

The tongue portion 28*b* of the locking mechanism 28 is adapted to engage with a selected one of the grooves 26, and the locking mechanism includes a spring 30 (not visible in FIG. 5; see FIG. 7) for biasing the locking mechanism in any such engaged position, which will be referred to as a locking configuration of the locking mechanism.

Manually pressing the lever portion 28*a* of the locking mechanism 28 against the bias provided by the spring 30 at the location and in the direction indicated by the open arrow in FIG. 6 rocks the locking mechanism about the axis T. This raises the tongue portion 28*b* relative to the groove 26 in which it was previously engaged, to disengage the locking mechanism therefrom and define an unlocked configuration of the locking mechanism.

When the locking mechanism is in its unlocked configuration, the capturing member 24 may be manipulated by sliding it axially along the cross-bar 22, to re-position the capturing member for subsequent locking at a new axial position. This is to allow for adjusting the axial spacing (i.e., along the elongate axis L) between the two capturing members 24 as needed for capturing the flange between them as described above.

The locking mechanism 28 is attached to a web "W" that serves, among other things, to stiffen the attachment of the capturing portions 29 to the respective capturing members 24. Significantly, in the preferred embodiment there is only one web "W" rather than the dual, spaced apart webs utilized in the prior art.

The web W of a capturing member 24 strengthens the capturing portion 29 by anchoring the latter to the former. The web W preferably defines a plane of symmetry "$P_1$" of the capturing member 24, and more preferably (as shown), this plane of symmetry also intersects the axis L. In these embodiments, the lever portion 28*a* of the locking mechanism 28 is split substantially in half (best seen at the capturing portion 24*b* in FIG. 5), one half extending to one side of the web W the other half extending to the other side of the web W. This bifurcation of the lever portion 28*a* allows the user to press on either or both halves of the lever portion 28*a* to operate the locking mechanism.

The present inventors have recognized that dual spaced apart webs such as used in the prior art are not required to guard the lever portion 28*a* from being inadvertently depressed as a result of coming into contact with a lanyard, particularly because depending the lever portion from a single web renders the lever portion much more accessible by the user, and it may as a result be oriented so that it extends more nearly parallel, and thus so that it lies closer, to the axis L of the cross-bar 22. This allows for eliminating at least one additional web to result in a less massive capturing member, providing for a desirable weight savings in the beam anchor 20. The present inventors have also found that the resulting "lower profile" of the lever portion 28*a* also allows the locking mechanism to be less massive than would be the case where the locking mechanism is supported between dual webs.

It is not essential that the web W be a plane of symmetry of the capturing member 24, or that the plane in which the web lies intersect the axis L, or that the lever portion 28*a* extend around both sides of the web W. It is also not essential that there be only one web W, or even that there be any web at all.

The central feature that allows the realization of the advantages described above is that the locking mechanism is pivotally connected to the capturing member 24 at a pivot element 34 that extends as a cantilever, i.e., the pivot element 34 is unsupported at its end. Where, as in the preferred embodiment of the invention, the pivot element 34 extends through a centrally disposed web such as the web W to support two halves of a lever portion 28*a*, the pivot element is centrally supported while being unsupported at either of its ends. Thus in the preferred configuration, the pivot element 34 has two cantilevered portions, extending outwardly from the web W in opposite directions.

Returning to FIG. 5, the cross-bar 22 has attached thereto a lanyard attachment structure 36, including a lanyard attachment ring 38 having a through aperture 39 for connecting to a lanyard, and a lanyard attachment ring connector 40 for connecting the lanyard attachment ring to the cross-bar 22. These are the same components provided in the prior art beam anchor 10. However, the lanyard attachment ring connector 40 is retained at a predetermined axial position on the cross-bar 22 by use of a novel ring structure 42.

The cross-bar 22 is preferably substantially cylindrical where the lanyard attachment ring connector is connected to the cross-bar. That is, the cross-bar preferably has a cylindrical or semi-cylindrical surface portion that allows for rotation of the lanyard attachment ring connector relative to the cross-bar, about the elongate axis L.

Preferably, the lanyard attachment ring connector is located close to or at the mid-point of the length of the cross-bar 22, at the location indicated as 25. A cylindrical exterior surface portion 37 of the cross-bar 22 at the location 25 makes contact with a corresponding cylindrical interior surface portion 41 of the lanyard attachment ring connector. The fit between the lanyards attachment ring connector 40 and the cross-bar 22 is sufficiently loose that force of contact does not provide significant resistance to rotating the lanyard attachment ring connector relative to the cross-bar in circumferential directions (indicated by solid arrows) about the axis L. The ring structure 42 is attached to the cross-bar 22, and projects radially outwardly therefrom either partially into or through an elongate slot 44 in the lanyard attachment ring connector 40. The slot 44 extends circumferentially about the cross-bar 22, allowing the lanyard attachment ring connector 40 only limited rotational freedom to swing about the axis L of the cross-bar 22. The ring-like projection into or through the slot 44 also constrains the lanyard attachment ring connector to a fixed axial position on the cross-bar.

An outstanding advantage provided by the ring structure 42 is that its shape allows it to grip the cross-bar, by extending more than 180 degrees around it, and therefore it can be fixed to the cross-bar without the need to weaken it, as would be the case following the prior art teachings of drilling the cross-bar and installing a pin or screw into the hole. For example, the ring structure 42 can be press fit or swaged onto the cross-bar 22 so that no metal needs to be removed from the cross-bar and no significant stress concentrations need to be created. Thus either less material can be used than is taught by the prior art as being necessary to achieve the same strength, resulting in significantly lower cost, or the same amount of material can be used, resulting in a cross-member that is significantly stronger.

It is to be understood that, while a specific beam anchor has been shown and described as preferred, other configurations could be utilized, in addition to those already mentioned, without departing from the principles of the invention. It should also be recognized that beam anchors according to the invention may be used to attach to any flanged beam, or any beam whether flanged or not, or any equivalent structure to which it is capable of being attached and utilized according to the principles described herein, an I-beam simply being the most common example of such structures.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A beam anchor for attaching to an I-beam or other flanged structure that has been made a part of a larger structure, to provide fall protection for a worker working on the larger structure, the beam anchor comprising:

an elongate cross-member defining an elongate axis and two opposed axial directions parallel thereto, said cross-member having an axially extending sequence of depressions therein;

a lanyard attachment structure attached to said cross-member;

a pair of first and second, spaced apart beam capturing members attached to said cross-member so that the spacing between said capturing members is adjustable, the capturing members including respective capturing portions for capturing the flange therebetween so that the beam anchor can hang therefrom; and a locking mechanism pivotally connected with an associated one of said capturing members via a pivot element, said locking mechanism having a lever adapted for digital manipulation by a user of the beam anchor for manipulating a depression-engaging portion of said locking mechanism, said lever supported by said pivot element along a first portion of said pivot element allowing the user to pivot said locking mechanism about said pivot element between a locked configuration wherein said locking mechanism pivotally engages with said cross-member by engaging said depression-engaging portion with a selected one of the depressions of said sequence, for locking the associated one of said capturing members to said cross-member at a selected axial position on said cross-member, and an unlocked configuration wherein said locking member pivotally disengages with said cross-member by disengaging said depression-engaging portion from the selected depression, to release the associated one of said capturing members from the selected axial position so that the associated one of said capturing members becomes slidable along the cross-member in either of said axial directions, wherein said first portion of said pivot element is cantilevered from said capturing member.

2. The beam anchor of claim 1, wherein the at least one of said capturing members includes a web element connecting to the associated capturing portion, wherein said pivot element extends from said web element.

3. The beam anchor of claim 2, wherein said lanyard attachment structure includes a lanyard attachment ring having an aperture therethrough for connecting to a lanyard, and a lanyard attachment ring connector for connecting said lanyard attachment ring to said cross-member, said lanyard attachment ring connector being disposed around said cross-member between said beam capturing members, said cross-member defining a cylindrical or semi-cylindrical cross-member surface about the elongate axis making cylindrical or semi-cylindrical contact with an interior surface of said lanyard attachment ring connector, said contact being sufficiently loose that said lanyard attachment ring connector is capable of rotation relative to said cross-member in circumferential directions about the elongate axis, said lanyard attachment ring connector having a slot extending in said circumferential directions to allow for said rotation, and said cross-member having a ring or ring-like projection at a predetermined fixed location thereon that extends more than 180 degrees therearound, and that projects into said slot, to capture said lanyard attachment ring connector to said cross-member by preventing sliding of said lanyard attachment ring connector on said cross-member parallel to the elongate axis.

4. The beam anchor of claim 3, wherein said ring or ring-like projection extends 360 degrees around said cross-member in said circumferential directions.

5. The beam anchor of claim 4, wherein said ring or ring-like projection exerts a compressive force on said cross-member, for fixing said ring or ring-like projection at said fixed location.

6. The beam anchor of claim 3, wherein said ring or ring-like projection exerts a compressive force on said cross-member, for fixing said ring or ring-like projection at said fixed location.

7. The beam anchor of claim 1, wherein said lanyard attachment structure includes a lanyard attachment ring having an aperture therethrough for connecting to a lanyard, and a lanyard attachment ring connector for connecting said lanyard attachment ring to said cross-member, said lanyard attachment ring connector being disposed around said cross-member between said beam capturing members, said cross-member defining a cylindrical or semi-cylindrical cross-member surface about the elongate axis making cylindrical or semi-cylindrical contact with an interior surface of said lanyard attachment ring connector, said contact being sufficiently loose that said lanyard attachment ring connector is allowed to rotate relative to said cross-member in circumferential directions about the elongate axis, said lanyard attachment ring connector having a slot extending in said circumferential directions, and said cross-member having a ring or ring-like projection at a predetermined fixed location thereon that extends more than 180 degrees therearound, and that projects into said slot, to capture said lanyard attachment ring connector to said cross-member by preventing sliding of said lanyard attachment ring connector on said cross-member parallel to the elongate axis.

8. The beam anchor of claim 7, wherein said ring or ring-like projection extends 360 degrees around said cross-member in said circumferential directions.

9. The beam anchor of claim 8, wherein said ring or ring-like projection exerts a compressive force on said cross-member, for fixing said ring or ring-like projection at said fixed location.

10. The beam anchor of claim 7, wherein said ring or ring-like projection exerts a compressive force on said cross-member, for fixing said ring or ring-like projection at said fixed location.

11. The beam anchor of claim 1, wherein said lever has distinct first and second portions, said first portion of said lever supported by said first portion of said pivot element, and said second portion of said lever supported by said pivot element along a second portion of said pivot element allowing the user to pivot said locking mechanism about said pivot element between said locked configuration and said unlocked configuration, wherein said second portion of said pivot element is cantilevered from said capturing member.

12. The beam anchor of claim 11, wherein the at least one of said capturing members includes a web element connecting to the associated capturing portion, wherein said pivot element extends from said web element, and wherein said first and second portions of said pivot element are on opposite sides of said web element.

13. The beam anchor of claim 12, wherein said lanyard attachment structure includes a lanyard attachment ring having an aperture therethrough for connecting to a lanyard, and a lanyard attachment ring connector for connecting said lanyard attachment ring to said cross-member, said lanyard attachment ring connector being disposed around said cross-member between said beam capturing members, said cross-member defining a cylindrical or semi-cylindrical cross-member surface about the elongate axis making cylindrical or semi-cylindrical contact with an interior surface of said lanyard attachment ring connector, said contact being sufficiently loose that said lanyard attachment ring connector is allowed to rotate relative to said cross-member in circumferential directions about the elongate axis, said lanyard attachment ring connector having a slot extending in said circumferential directions, and said cross-member having a ring or ring-like projection at a predetermined fixed location thereon that extends more than 180 degrees therearound, and that projects into said slot, to capture said lanyard attachment ring connector to said cross-member by preventing sliding of said lanyard attachment ring connector on said cross-member parallel to the elongate axis.

14. The beam anchor of claim 13, wherein said ring or ring-like projection extends 360 degrees around said cross-member in said circumferential directions.

15. The beam anchor of claim 14, wherein said ring or ring-like projection exerts a compressive force on said cross-member, for fixing said ring or ring-like projection at said fixed location.

16. The beam anchor of claim 13, wherein said ring or ring-like projection exerts a compressive force on said cross-member, for fixing said ring or ring-like projection at said fixed location.

17. The beam anchor of claim 11, wherein said lanyard attachment structure includes a lanyard attachment ring having an aperture therethrough for connecting to a lanyard, and a lanyard attachment ring connector for connecting said lanyard attachment ring to said cross-member, said lanyard attachment ring connector being disposed around said cross-member between said beam capturing members, said cross-member defining a cylindrical or semi-cylindrical cross-member surface about the elongate axis making cylindrical or semi-cylindrical contact with an interior surface of said lanyard attachment ring connector, said contact being sufficiently loose that said lanyard attachment ring connector is allowed to rotate relative to said cross-member in circumferential directions about the elongate axis, said lanyard attachment ring connector having a slot extending in said circumferential directions, and said cross-member having a ring or ring-like projection at a predetermined fixed location thereon that extends more than 180 degrees therearound, and that projects into said slot, to capture said lanyard attachment ring connector to said cross-member by preventing sliding of said lanyard attachment ring connector on said cross-member parallel to the elongate axis.

18. The beam anchor of claim 17, wherein said ring or ring-like projection extends 360 degrees around said cross-member in said circumferential directions.

19. The beam anchor of claim 18, wherein said ring or ring-like projection exerts a compressive force on said cross-member, for fixing said ring or ring-like projection at said fixed location.

20. The beam anchor of claim 17, wherein said ring or ring-like projection exerts a compressive force on said cross-member, for fixing said ring or ring-like projection at said fixed location.

21. A beam anchor for attaching to a flanged beam or the like that has been made a part of a structure, to provide fall protection for a worker working on the structure, the beam anchor comprising:

an elongate cross-member defining an elongate axis and two opposed axial directions;

a pair of first and second, spaced apart beam capturing members attached to said cross-member so that the spacing between said capturing members is adjustable, at least one of said capturing members including a capturing portion for hooking onto a flange of the I-beam; and a lanyard attachment structure attached to said cross-member, said lanyard attachment structure including a lanyard attachment ring having an aperture therethrough for connecting to a lanyard, and a lanyard attachment ring connector for connecting said lanyard attachment ring to said cross-member, said lanyard attachment ring connector being disposed around said cross-member between said beam capturing members, said cross-member defining a cylindrical or semi-cylindrical cross-member surface about the elongate axis making cylindrical or semi-cylindrical contact with an interior surface of said lanyard attachment ring connector, said contact being sufficiently loose that said lanyard attachment ring connector is allowed to rotate relative to said cross-member in circumferential directions about the elongate axis, said lanyard attachment ring connector having a slot extending in said circumferential directions, and said cross-member having a ring or ring-like projection at a predetermined fixed location thereon that extends more than 180 degrees therearound, and that projects into said slot, to capture said lanyard attachment ring connector to said cross-member by preventing sliding of said lanyard attachment ring connector on said cross-member parallel to the elongate axis.

22. The beam anchor of claim 21, wherein said ring or ring-like projection extends 360 degrees around said cross-member in said circumferential directions.

23. The beam anchor of claim 22, wherein said ring or ring-like projection exerts a compressive force on said cross-member, for fixing it at said fixed location.

* * * * *